US010450636B2

(12) United States Patent
Watson et al.

(10) Patent No.: US 10,450,636 B2
(45) Date of Patent: Oct. 22, 2019

(54) ALUMINUM ALLOYS AND MANUFACTURE METHODS

(71) Applicant: United Technologies Corporation, Hartford, CT (US)

(72) Inventors: Thomas J. Watson, South Windsor, CT (US); Iuliana Cernatescu, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 791 days.

(21) Appl. No.: 14/902,709

(22) PCT Filed: Jul. 9, 2014

(86) PCT No.: PCT/US2014/045982
§ 371 (c)(1),
(2) Date: Jan. 4, 2016

(87) PCT Pub. No.: WO2015/006466
PCT Pub. Date: Jan. 15, 2015

(65) Prior Publication Data

US 2016/0168663 A1 Jun. 16, 2016

Related U.S. Application Data

(60) Provisional application No. 61/844,762, filed on Jul. 10, 2013.

(51) Int. Cl.
*C22C 21/00* (2006.01)
*B22F 3/02* (2006.01)
(Continued)

(52) U.S. Cl.
CPC ..... *C22C 21/00* (2013.01); *B22F 3/02* (2013.01); *B22F 3/17* (2013.01); *B22F 3/20* (2013.01);
(Continued)

(58) Field of Classification Search
CPC ..... C22C 21/00; C22C 1/0416; C22F 1/04; B22F 3/02; B22F 9/04; B22F 3/17; B22F 3/20
See application file for complete search history.

(56) References Cited

U.S. PATENT DOCUMENTS 4,772,370 A 9/1988 Kreider
5,334,266 A 8/1994 Kawanishi et al.
(Continued)

FOREIGN PATENT DOCUMENTS

EP 0675209 A1 10/1995
JP 6316738 A 11/1994
JP 0892680 A 4/1996

OTHER PUBLICATIONS

Hisamichi Kimura et al., Mechanical Properties of Al—Cr Base Alloys Containing Icosahedral Phase Produced by Extrusion of Atomized Powder, Mar. 6, 1997, Journal of the Japan Society of Powder and Powder Metallurgy, Japan.
(Continued)

*Primary Examiner* — George Wyszomierski
*Assistant Examiner* — Janell C Morillo
(74) *Attorney, Agent, or Firm* — Bachman & LaPointe, P.C.

(57) ABSTRACT

A composition comprises, in weight percent: Al as a largest constituent; 3.0 6.0 Cr; 1.5 4.0 Mn; 0.1 3.5 Co; and 0.3 2.0 Zr.

17 Claims, 17 Drawing Sheets

(51) Int. Cl.

| | |
|---|---|
| ***B22F 3/17*** | (2006.01) |
| ***B22F 3/20*** | (2006.01) |
| ***B22F 9/04*** | (2006.01) |
| ***C22F 1/04*** | (2006.01) |
| ***C22C 1/04*** | (2006.01) |

(52) U.S. Cl.

CPC ..... *B22F 9/04* (2013.01); *C22C 1/0416* (2013.01); *C22F 1/04* (2013.01); *B22F 2301/052* (2013.01)

(56) References Cited

U.S. PATENT DOCUMENTS

| | | | | |
|---|---|---|---|---|
| 5,431,751 | A | | 7/1995 | Okochi et al. |
| 5,593,515 | A | * | 1/1997 | Masumoto ..... C22C 1/0416 148/403 |
| 5,607,523 | A | | 3/1997 | Masumoto et al. |
| 5,693,897 | A | | 12/1997 | Kita |
| 5,900,210 | A | | 5/1999 | Buchler et al. |
| 6,017,403 | A | | 1/2000 | Masumoto et al. |
| 6,056,802 | A | | 5/2000 | Kita et al. |
| 6,074,497 | A | | 6/2000 | Inoue et al. |
| 6,149,737 | A | | 11/2000 | Hattori et al. |
| 6,334,911 | B2 | | 1/2002 | Kita et al. |
| 2008/0308197 | A1 | | 12/2008 | Watson et al. |
| 2010/0003536 | A1 | | 1/2010 | Smith et al. |
| 2012/0024110 | A1 | | 2/2012 | Watson |
| 2012/0325051 | A1 | | 12/2012 | Watson |
| 2012/0325378 | A1 | | 12/2012 | Watson |
| 2012/0328470 | A1 | | 12/2012 | Watson |
| 2012/0328472 | A1 | | 12/2012 | Watson et al. |

OTHER PUBLICATIONS

European Search Report dated Feb. 17, 2017 for EP Patent Application No. 14822973.5.

Kazuhiko Kita et al., Mechanical Properties of A1 Based Alloys Containing Quasi-crystalline Phase as a Main Component, Materials Science and Engineering: A, Jun. 15, 1997, pp. 1004-1007, Elsevier Sciences S.A. Amsterdam, Netherlands.

F. Schurack et al., High Strength Al-Alloys with Nano-Quasicrystalline Phase as Main Component, NanoStructured Materials, Oct. 6, 1999, pp. 107-110, Elsevier Science Ltd., London, United Kingdom.

Akihisa Inoue et al., High-Strength Aluminum Alloys Containing Nanoquasicrystalline Particles, Materials Science and Engineering: A, Jun. 30, 2000, pp. 1-10, Elsevier Sciences S.A. Amsterdam, Netherlands.

International Search Report and Written Opinion for PCT/US2014/045982 dated Nov. 27, 2014.

European Office Action dated Mar. 8, 2019 for European Patent Application No. 14822973.5.

* cited by examiner

| Product Form | | Elemental Concentration (w/o) | | | | | | | Total Hydrogen (ppm) | Oxygen (ppm) | Carbon (ppm) |
|---|---|---|---|---|---|---|---|---|---|---|---|
| | | Al | Cr | Mn | Co | Zr | Fe | Si | | | |
| - | | 87.70 | 4.70 | 2.90 | 3.10 | 1.60 | < 0.02 | < 0.02 | - | - | - |
| Master Alloy | | 88.16 | 4.59 | 2.79 | 2.83 | 1.61 | 0.01 | < 0.01 | < 1 (0.34) | 190 | 15 |
| Powder (After Sieving ) | | 87.59 | 4.74 | 2.90 | 3.16 | 1.53 | 0.06 | 0.02 | 58 | - | - |
| Extrusion | | 87.23 | 4.96 | 2.84 | 3.14 | 1.50 | 0.31 | 0.02 | 4 (4.1) | 1400 | 100 |

*FIG. 5*

| Depth Below the Surface (μm) | Elemental Concentration (ppm by Weight) | | | | | | | |
|---|---|---|---|---|---|---|---|---|
| | Aluminum (Al) | Chromium (Cr) | Manganese (Mn) | Cobalt (Co) | Zirconium (Zr) | Sodium (Na) | Chlorine (Cl) | Oxygen (O) |
| 0 | - | - | - | - | - | - | - | - |
| 2 | 1,000,000 | 2,000 | 5,600 | 3,600 | 950 | 2,200 | 26,000 | 1,000,000 |
| 4 | 1,000,000 | 15,000 | 8,200 | 9,800 | 7,400 | 960 | 16,000 | 1,000,000 |
| 6 | 1,000,000 | 48,000 | 17,000 | 16,000 | 14,000 | 280 | 9,200 | 1,000,000 |
| 8 | 1,000,000 | 55,000 | 28,000 | 31,000 | 20,000 | 85 | 4,600 | 1,000,000 |
| 10 | 1,000,000 | 53,000 | 24,000 | 48,000 | 23,000 | 26 | 2,000 | 1,000,000 |
| 12 | 1,000,000 | 45,000 | 25,000 | 37,000 | 20,000 | 22 | 1,200 | 1,000,000 |
| 14 | 1,000,000 | 41,000 | 21,000 | 40,000 | 22,000 | 13 | 910 | 1,000,000 |
| 16 | 1,000,000 | 42,000 | 18,000 | 35,000 | 13,000 | 8 | 570 | 8,500 |
| 18 | 1,000,000 | 73,000 | 21,000 | 39,000 | 19,000 | 9 | 520 | 9,000 |
| 20 | 1,000,000 | 55,000 | 31,000 | 39,000 | 18,000 | 380 | 440 | 10,000 |
| 22 | 1,000,000 | 52,000 | 38,000 | 37,000 | 15,000 | 170 | 260 | 9,200 |
| 24 | 1,000,000 | 47,000 | 27,000 | 32,000 | 17,000 | 23 | 30 | 9,000 |
| 26 | 1,000,000 | 53,000 | 33,000 | 37,000 | 17,000 | 17 | 24 | 1,600 |
| 28 | 1,000,000 | 43,000 | 25,000 | 24,000 | 13,000 | 15 | 17 | 1,700 |
| 30 | 1,000,000 | 59,000 | 32,000 | 32,000 | 16,000 | 15 | 15 | 1,900 |
| 32 | 1,000,000 | 43,000 | 27,000 | 31,000 | 14,000 | 13 | 14 | 1,500 |
| 34 | 1,000,000 | 45,000 | 29,000 | 30,000 | 16,000 | 11 | 13 | 1,800 |
| 36 | 1,000,000 | 52,000 | 36,000 | 37,000 | 17,000 | 12 | 18 | 1,900 |

*FIG. 6*

ALUMINUM ALLOYS AND MANUFACTURE METHODS

CROSS REFERENCE TO RELATED APPLICATION

Benefit is claimed of U.S. Patent Application Ser. No. 61/844,762, filed Jul. 10, 2013, and entitled "Aluminum Alloys and Manufacture Methods", the disclosure of which is incorporated by reference herein in its entirety as if set forth at length.

BACKGROUND

The disclosure relates to aluminum alloys. More particularly, the disclosure relates to aluminum alloys containing an icosahedral phase (I-phase) for use in aerospace applications.

Since the discovery of the existence of an icosahedral phase (I-phase) in 1984, a number of documents discuss the composition and mechanical properties of aluminum alloys containing such a phase. Examples include U.S. Pat. No. 4,772,370 and US Patent Application Publication 2010/0003536A1. More recently, the idea of using I-phase materials for coatings has also surfaced. While many references assert that aluminum alloys with the I-phase have high ductility, these measurements are usually based on bending and such a mode of stress does not, in general, coincide with the ability of a material to deform in pure tension. Tests in pure tension have shown that I-phase materials behave poorly, often exhibiting tensile failures near 1% elongation. This behavior has often been attributed to the high volume fractions (e.g., as high as 80%, see U.S. Pat. No. 6,334,911) of I-phase produced in alloys explored to date. However, a variety of other factors can be involved; that is, hydrogen content, phases that have a low volume fraction, but embrittle aluminum alloys, or the size and distribution of I-phase particles, even at low volume fractions.

It has been documented that transition metal elements such as Co can be added to ternary aluminum I-phase alloys, such as Al—Cr—Co or Al—Mn—Co, and this results in a finer size and distribution of I-phase particles. See, K. Kita, K. Saitoh, A. Inoue, T. Masumoto, "Mechanical Properties of Al Based Alloys Containing Quasi-crystalline Phase as a Main Component", *Materials Science and Engineering*, A226-228, 1997, pp. 1004-1007 (hereafter "Kita et al."). Kita et al. assert that this results in greater strength, although it is not clear that some strength is not derived from the compound $Al_9Co_2$.

SUMMARY

One aspect of the disclosure involves a composition comprising, in weight percent: Al as a largest constituent; 3.0-6.0 Cr; 1.5-4.0 Mn; 0.1-3.5 Co; and 0.3-2.0 Zr.

In one or more embodiments of any of the foregoing embodiments, in atomic percent content Co divided by the sum (Cr+Mn) less than or equal to 0.07.

In one or more embodiments of any of the foregoing embodiments, in atomic percent content Co divided by the sum (Cr+Mn) less than or equal to 0.065.

In one or more embodiments of any of the foregoing embodiments, the composition in weight percent comprises: 3.0-6.0 Cr; 1.5-4.0 Mn; 0.1-1.0 Co; and 0.3-1.5 Zr.

In one or more embodiments of any of the foregoing embodiments, the composition in weight percent comprises: 3.7-5.2 Cr; 2.1-3.0 Mn; 0.4-0.6 Co; and 0.7-1.1 Zr.

In one or more embodiments of any of the foregoing embodiments, the composition in atomic percent comprises: 1.9-2.9 Cr; 1.0-1.6 Mn; 0.2-0.3 Co; and 0.2-0.4 Zr.

In one or more embodiments of any of the foregoing embodiments, in weight percent the total of all additional contents is not more than 5.0.

In one or more embodiments of any of the foregoing embodiments, in weight percent no additional individual elemental content exceeds 1.0.

In one or more embodiments of any of the foregoing embodiments, the composition in weight percent, having each of Fe and Si content, if any, does not exceed 0.02.

In one or more embodiments of any of the foregoing embodiments, by weight H content, if any, does not exceed 1 ppm.

In one or more embodiments of any of the foregoing embodiments, the composition has an icosahedral phase (I-phase).

In one or more embodiments of any of the foregoing embodiments, a volume fraction of said I-phase is 15% to 30%.

In one or more embodiments of any of the foregoing embodiments, a characteristic size of said I-phase is less than 200 nm.

In one or more embodiments of any of the foregoing embodiments, $Al_9Co_2$ content, if any, is less than 5% by volume.

Another aspect of the disclosure involves a method for manufacturing the composition. The method comprises atomizing a master alloy, pressing the atomized alloy to form a billet, extruding the billet to form an extrusion, and forging the extrusion.

In one or more embodiments of any of the foregoing embodiments, the composition comprises, in atomic percent: Al as a largest constituent; 1.9-2.9 Cr; 1.0-1.6 Mn; 0.2-0.3 Co; and 0.2-0.4 Zr.

In one or more embodiments of any of the foregoing embodiments, the composition has an icosahedral phase (I-phase).

In one or more embodiments of any of the foregoing embodiments, a volume fraction of said I-phase is 15% to 30%.

In one or more embodiments of any of the foregoing embodiments, the composition is a powder metallurgical alloy.

In one or more embodiments of any of the foregoing embodiments, the composition is effective to form a passivating layer when exposed to a salt-fog environment.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 5 is a table of wet chemistry of the Test 1 alloy.

FIG. 6 is a table of depthwise elemental concentration measured by glow discharge mass spectroscopy of the FIG. 4 specimen.

Like reference numbers and designations in the various drawings indicate like elements.

DETAILED DESCRIPTION

Figure 1:
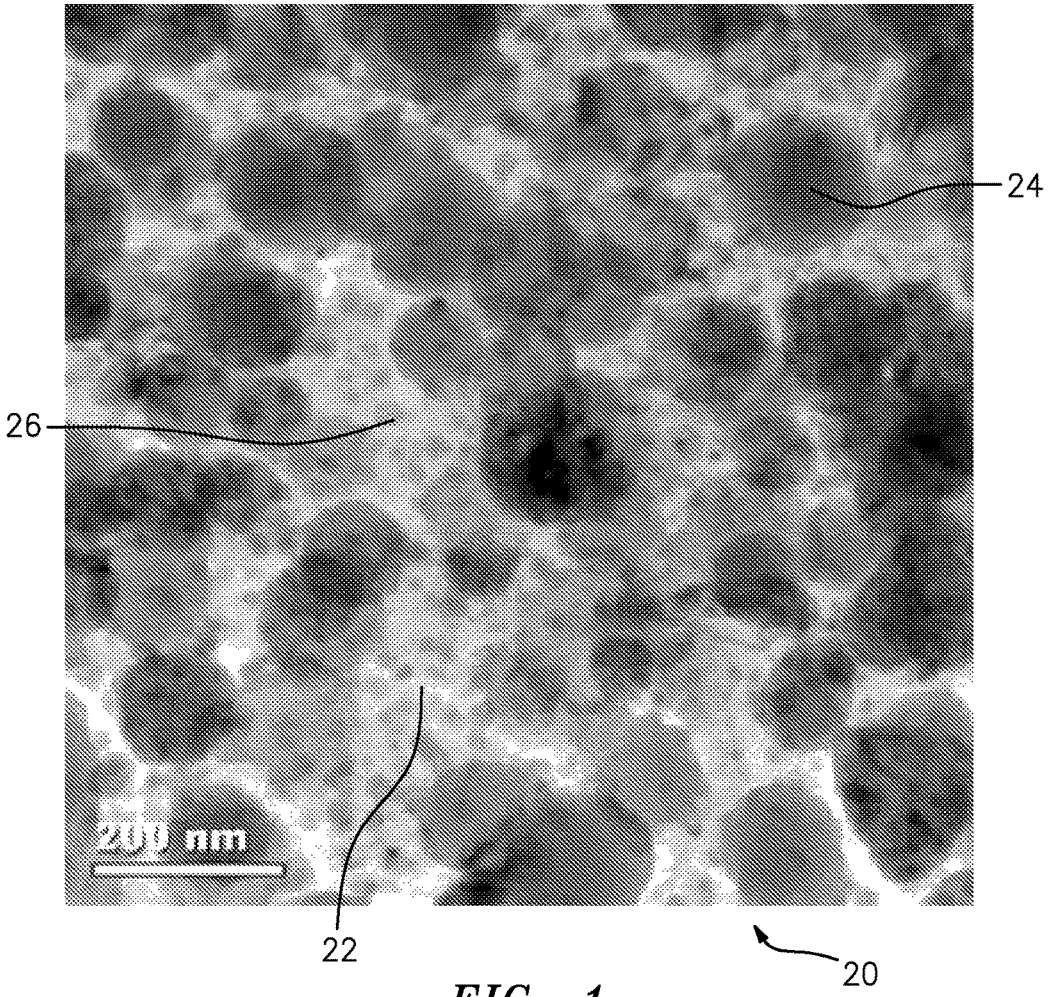
FIG. 1 is a bright-field transmission electron microscope (TEM) micrograph (image) of a tested ("Test 1") alloy microstructure.

We have determined that above a certain Co level, the Co exceeds the solubility limit of the I-phase particles, forms $Al_9Co_2$, and embrittles the material. We have also found that the presence of the $Al_9Co_2$ phase precludes effective degassing because it forms at temperatures where degassing normally occurs. To preclude the formation of this phase, one is forced to degas at lower temperatures and this results in a high hydrogen content. However, when hydrogen is greater than 1 ppm in nanostructural materials, the ductility suffers. Finally, when Cr and Mn exceeds values that are above those needed to provide a volume fraction of I-phase greater than 25%, ductility also suffers.

First, by reducing Co levels to those needed to provide for a small size and a more even size distribution of the I-phase, without forming $Al_9Co_2$, one may obtain alloys that have better ductility than the prior art.

Second, by eliminating or substantially reducing the Co-induced formation of $Al_9Co_2$, one may obtain alloys that can be degassed at higher temperatures, thereby resulting in lower hydrogen concentrations, thus leading to improved ductility. We have found that keeping hydrogen below 1 ppm provides for excellent ductility, particularly in nanostructural materials like the I-phase alloys.

Third, by lowering Cr and Mn levels, one may eliminate the formation of primary I-phase particles that come out in powder particles while they are still liquid. Such particles grow rapidly in the liquid (typically to 500 nm and larger) and do not contribute to strength, but only serve to lower ductility. Hence, with lower Cr and Mn levels, only small I-phase particles form (typically 200 nm or less, more particularly, 50 nm or less) and these allow for both good strength and ductility.

Thus, we have determined that above a certain Co level, the Co exceeds the solubility limit of the I-phase particles, forms $Al_9Co_2$, and embrittles the material. We have endeavored to more particularly define the relevant Co level relative to Cr and Mn levels. In one approximation, this involves the atomic percentage ratio of Co to the sum of Cr and Mn contents. Above about 0.065 will result in the formation of $Al_9Co_2$. When one alters the Cr and Mn levels, the Co level must accordingly change to maintain the ratio to control/limit I-phase.

In general, the Zr serves to thermally stabilize the I-phase. A desirable Zr level is sufficient to prevent thermally-induced I-phase coarsening (such coarsening would lower strength) while not being so high as to form undesirably large $Al_3Zr$ particles. Such $Al_3Zr$ particles, instead of behaving as fine dispersoids for grain size control, behave more like insoluble particles that lead to reduced ductility and fracture properties.

Table I below shows the measured composition of a tested material ("Test 1"). Weight and atomic percentages of Cr, Mn, Co, and Zr are given. The balance was Al with at most impurity levels of other components. Specifically, the contents of H, Fe, and Si were particularly sensitive with by weight amounts of less than 1 ppm H and less than 0.02% each for Fe and Si. Properties for the Test 1 composition are discussed below and were used to model target nominal values for three further examples. Although the test data shows advantageous performance, the modeling suggests even greater benefit to compositions having at least slightly lower Zr and substantially lower Co.

TABLE I

| | W/A | Element | | | | Co/(Cr + | I-Phase |
|---|---|---|---|---|---|---|---|
| Example | % | Cr | Mn | Co | Zr | Mn) | %* |
| Range 1 | W | 3.7-5.2 | 2.1-3.0 | 0.4-0.6 | 0.7-1.1 | | |
| | A | 1.9-2.9 | 1.0-1.6 | 0.18-0.3 | 0.2-0.4 | | |
| Range 2 | W | 3.5-5.5 | 1.9-3.2 | 0.3-0.8 | 0.5-1.2 | | |
| Range 3 | W | 3.0-6.0 | 1.5-4.0 | 0.1-1.0 | 0.3-1.5 | | |
| Range 4 | W | 3.0-6.0 | 1.5-4.0 | 0.1-3.5 | 0.3-2.0 | | |
| Test 1 | W | 4.96 | 2.84 | 3.14 | 1.5 | | 28 |
| | A | 2.76 | 1.49 | 1.54 | 0.48 | 0.362 | |
| Example 1 | W | 3.7 | 2.1 | 0.42 | 0.99 | — | 20 |
| | A | 1.995 | 1.082 | 0.2 | 0.304 | 0.063 | |
| Example 2 | W | 4.59 | 2.63 | 0.51 | 0.99 | — | 25 |
| | A | 2.495 | 1.353 | 0.245 | 0.307 | 0.064 | |
| Example 3 | W | 5.12 | 2.93 | 0.57 | 0.98 | — | 28 |
| | A | 2.795 | 1.514 | 0.275 | 0.305 | 0.064 | |
| Prior art 1 | A | 7 | 0 | 0 | 0 | | |
| Prior art 2 | A | 6 | 0 | 1 | 0 | | |
| Prior art 3 | A | 5 | 0 | 2 | 0 | | |
| Prior art 4 | A | 4 | 0 | 3 | 0 | | |
| Prior art 5 | A | 0 | 7 | 0 | 0 | | |
| Prior art 6 | A | 0 | 6 | 1 | 0 | | |
| Prior art 7 | A | 0 | 5 | 2 | 0 | | |
| Prior art 8 | A | 0 | 4 | 3 | 0 | | |
| Prior art 9 | A | 0 | 3 | 4 | 0 | | |

*Estimate except for Test 1 value

In an exemplary process of manufacture, the master alloy is formed (See, e.g., US Patent Application Publication 2012/0328470A1).

The master alloy is atomized (See, e.g., US Patent Application Publication 2012/0325051A1).

A vacuum hot-press (VHP) billet is then formed (See, e.g., US Patent Application Publication 2012/0024110A1). Prior to VHP, hot stage X-ray diffraction was used to identify when and if $Al_9Co_2$ would form in the powder. Because $Al_9Co_2$ began to form at 650 F (343° C.), degassing was at 600 F (316° C.) rather than 700 F (371° C.; 700 F (371° C.). previously being used to keep H content to less than 1 ppm by weight).

After billet production is an extrusion and forging process. An extrusion ratio of between 2:1 and 8:1 was used to limit the adiabatic heating associated with higher ratios. Such heating reduces strength. Such extrusion is discussed in US Patent Application Publication 2012/0325378A1. Exemplary forging is discussed in US Patent Application Publications 2008/0308197A1 and 2012/0328472A1.

In terms of I-phase generation, at 28 volume percent characteristic (e.g., average) I-phase particle size of the Test 1 sample was between 190 and 230 nanometers. At 25 volume percent, the size is calculated to be between 170 and 200 nanometers. At 20 volume percent, the size is calculated to be between 130 and 150 nanometers.

The three example alloys were specifically modeled to provide three different predicted I-phase volume percentages of 20%, 25%, and 28%, respectively, without any substantial $Al_9Co_2$. The three example alloys have a lower Zr content than the test alloy selected to preferably eliminate insoluble $Al_3Zr$ formation. The three Zr values are identical merely to obtain better data on the effect of Co. Three exemplary compositional ranges are also given to encompass these. A fourth compositional range is selected to also include the Test 1 material. Additional ranges could be formed around the Test 1 alloy or any of the examples by merely providing ±0.30 weight percent variation for each of the four alloying elements Co, Cr, Mn, and Zr. In each range, aluminum would form the majority by weight percent of the composition and, more particularly, substantially the remainder/balance (e.g., enough of the remainder to avoid significant compromise in properties). For example, to the extent any constituents beyond the enumerated Al, Cr, Mn, Co, and Zr are present, they would be expected to aggregate no more than 5 weight percent (more narrowly, no more than 2 weight percent and yet more narrowly, no more than 1 weight percent). Each additional element, individually, would be expected to be no more than 2 weight percent, more narrowly, no more than 1.0 weight percent, more particularly, no more than 0.5 weight percent.

However, as noted above, there are several specific elements for which much lower upper limits may be present. These include H, Fe, and Si. Exemplary maximum H is no more than 10 ppm, more narrowly, 5 ppm, more narrowly, 2 ppm, more narrowly, no more than 10 ppm, more narrowly, 5 ppm, more narrowly, 1 ppm. Exemplary Fe and Si maximum contents are each no more than 0.1 weight percent, more particularly, no more than 0.05 weight percent or 0.03 weight percent or 0.02 weight percent.

As noted above, for any of these ranges the atomic ratio of Co to the sum of Cr and Mn may be at most 0.065, more broadly, at most 0.07 or 0.10, and more narrowly, 0.050-0.065.

Exemplary $Al_9Co_2$ content, if any, is less than 5.0% by volume, more particularly, less than 2.0% or less than 1.0%.

Furthermore, exemplary I-phase volume percentage is less than 30%, more particularly, 15% to 30% or 18% to 28%. Exemplary characteristic (e.g., average) I-phase size is less than 1000 nm, more particularly, less than 500 nm or less than 200 nm.

Measured yield strength of the Test 1 alloy show greater yield strength than typical baseline aluminum fan alloys (e.g., 2060-T852 and 7255-T7452) by about 10-20% over a range from about ambient temperature (72 F (22° C.)) to 250 F (121° C.). Yield strength of the Test 1 alloy is slightly less (about 10-20% less) than Ti-6Al-4V over a range from ambient to approximately 600 F. However, specific yield strength exceeds that of both the Ti-6Al-4V and the baseline aluminum alloys over such temperature ranges (e.g., by at least about 10%). This evidences the ability to save weight when replacing either the Ti-6Al-4V or the baseline aluminum alloys.

Similar results are present with elastic modulus. The elastic modulus Test 1 alloy falls between that of the baseline aluminum alloys over the 72-600 F (22-316° C.) range on the one hand and below that of the Ti-6Al-4V on the other hand. However, the specific elastic modulus substantially exceeds these three prior art alloys over such range. The slightly greater advantage at lower temperature than at higher temperature is still at least about a 10% advantage over the Ti-6Al-4V and 7255 at the higher end of that range and at least about 5% over the 2060 at the higher end of that range.

On average, the coefficient of thermal expansion is reduced slightly relative to the two baseline alloys over the 72-600 F (22-316° C.) range. For the Test 1 material, the ductility varied between 5 and 6% elongation with a strength level greater than 100 Ksi (689 MPa). However, this material has high hydrogen (4 ppm, see FIG. 5) and also contains $Al_9Co_2$; hence, its ductility is down. By correcting these issues and with the lower volume fractions described by the Example alloys in Table I, it is expected that ductilities will be 10% or better. The Test 1 material was also found to be thermally stable, with yield strength nearly constant (e.g., for 1000 hours at 500 F (260° C.) and 600 F (316° C.) (with decays, if any, in yield strength less than 20%, and closer to 10% or less). This is in clear contrast to modern conventional (ingot metallurgy) aluminum alloys 7255-T452 and 2060-T852.

Additionally, corrosion resistance of the Test 1 alloy has been observed as improved relative to 7055-T7451, 7255-T7452, 2060-T852, and 6061-T6. This is measured as substantially lower average pit depth in salt-fog testing (e.g., ASTM B117 (neutral PH)). Exemplary average maximum pit depth was less than half of all of these baseline alloys in salt-fog testing from five hundred hours to over one thousand hours. Exemplary pit density (number of pits per unit of surface area) was even more dramatically lower (e.g., less than 10% of the density and potentially down to fractions of a percent).

Figure 10:
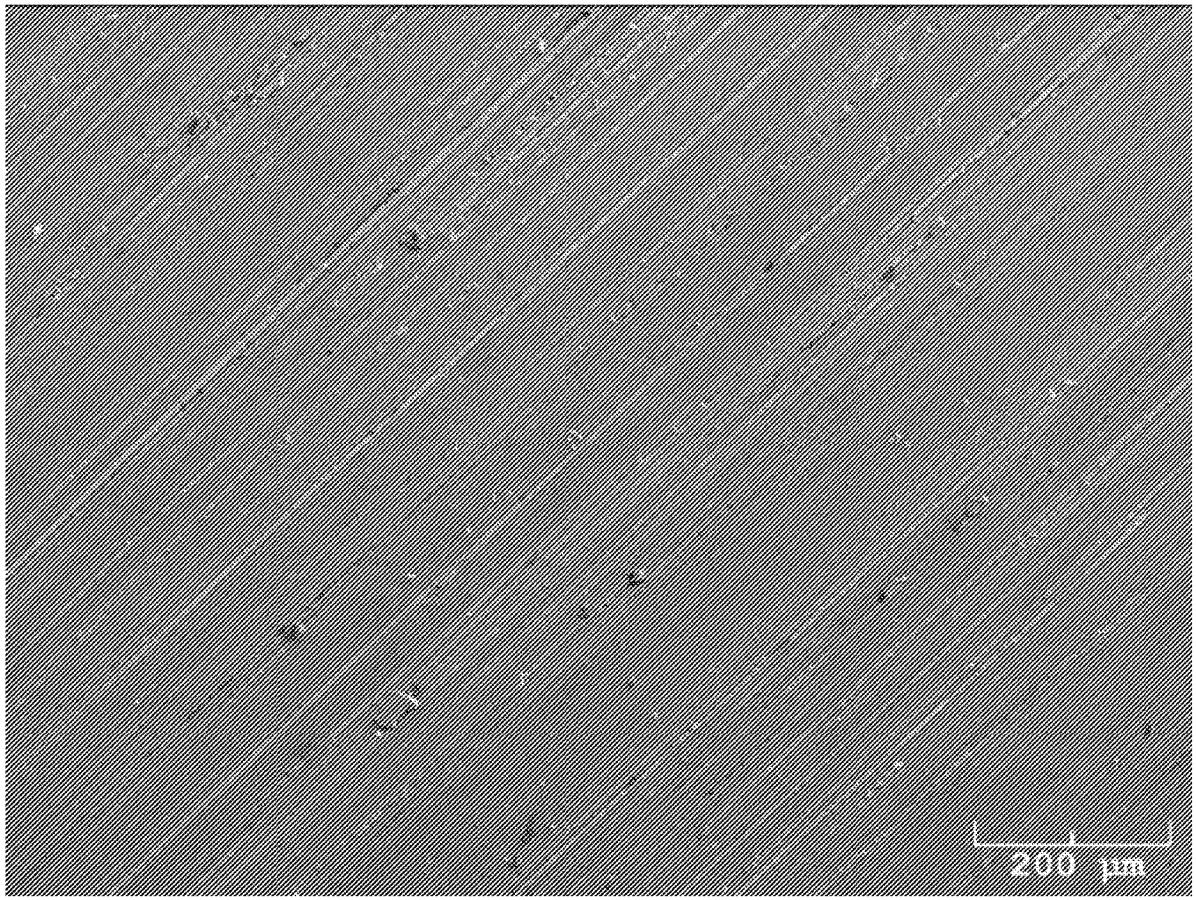
FIG. 10 is an SEM view of the Test 1 alloy prior to salt-exposure.

This improvement in corrosion resistance is associated with a passivating layer forming in the salt-fog chamber because of the composition of the alloy. That is, the bare surface as shown in FIG. 10 is what is placed in the harsh corrosive environment of the salt-fog chamber. The passivating layer forms in this environment, effectively eliminating/minimizing the formation and growth of pits. The passivating layer is a thin layer of oxide that forms on the metallic surface, making the metal less susceptible to its surrounding environment. This oxide layer does so by greatly reducing the transport of corrosive species to the underlying metal.

In general, freshly exposed metallic surfaces will adsorb and react with oxygen present in the atmosphere almost instantaneously. With aluminum, this forms a thin oxidation layer that is easily breached, simply by handling. The breach leads to further oxidation that is similarly subject to breach.

Hence, processes have been developed such as anodization, which places a thick, hard, oxide layer on the aluminum. This oxide is less easily removed. However, if the anodization layer is breached (e.g., due to a scratch or dent), the area of exposed aluminum will rapidly corrode. The self-passivating ability can form an anodization-like passivating layer with thickness on the order of several micrometers, in distinction to typical oxidation layers which may be two or more orders of magnitude thinner.

Figure 18:
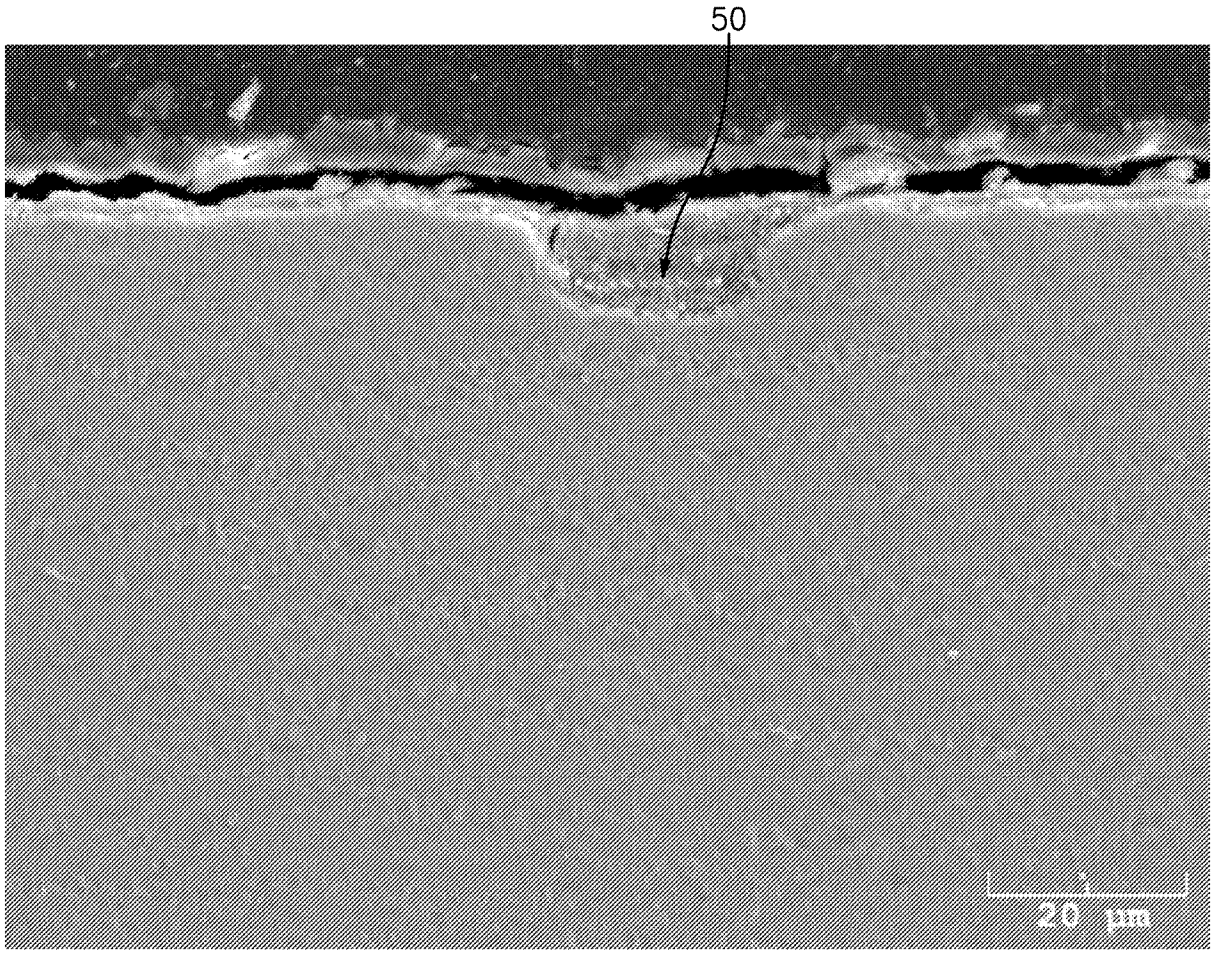
FIG. 18 is a sectional electron microprobe image of a pit filled by passivating layer material.

An observed self-healing of pits is believed to involve such passivating in that the metal spontaneously forms a thicker oxide (like one would normally apply by anodization) after it has been damaged (e.g., by scratching, impact, erosion, and the like). Where pits do grow, these are precluded from growing further, as shown in FIG. 18. When the alloy is damaged (e.g., scratched), it again will heal its surface, precluding corrosion pitting in the damaged area. Because pitting is the greatest durability threat to aluminum alloys, particularly rotating hardware, this is a significant improvement over the prior art. Finally, this ability to "self-heal" is a significant improvement over conventional aluminum alloys that have barrier coatings or anodized surfaces, specifically non-hexavalent chrome (green) anodized surfaces, in that if the surfaces of coated conventional aluminum alloys are scratched, there no longer is a protective layer, and these conventional alloys will begin to corrode immediately and continue to corrode.

FIG. 1 is a bright field transmission electron microscope (TEM) micrograph of the Test 1 alloy microstructure in the as-received condition (as forged, prior to aging or other elevated temperature exposure). In the material 20, pure aluminum 22 appears as a white area and contains a bimodal distribution of spherical I-phase: large I-phase 24 (e.g., about 200 nm) contributes to higher modulus and not strength; fine I-phase 26 (e.g., about less than or equal to 20 nm) contributes to strength.

Figure 2:
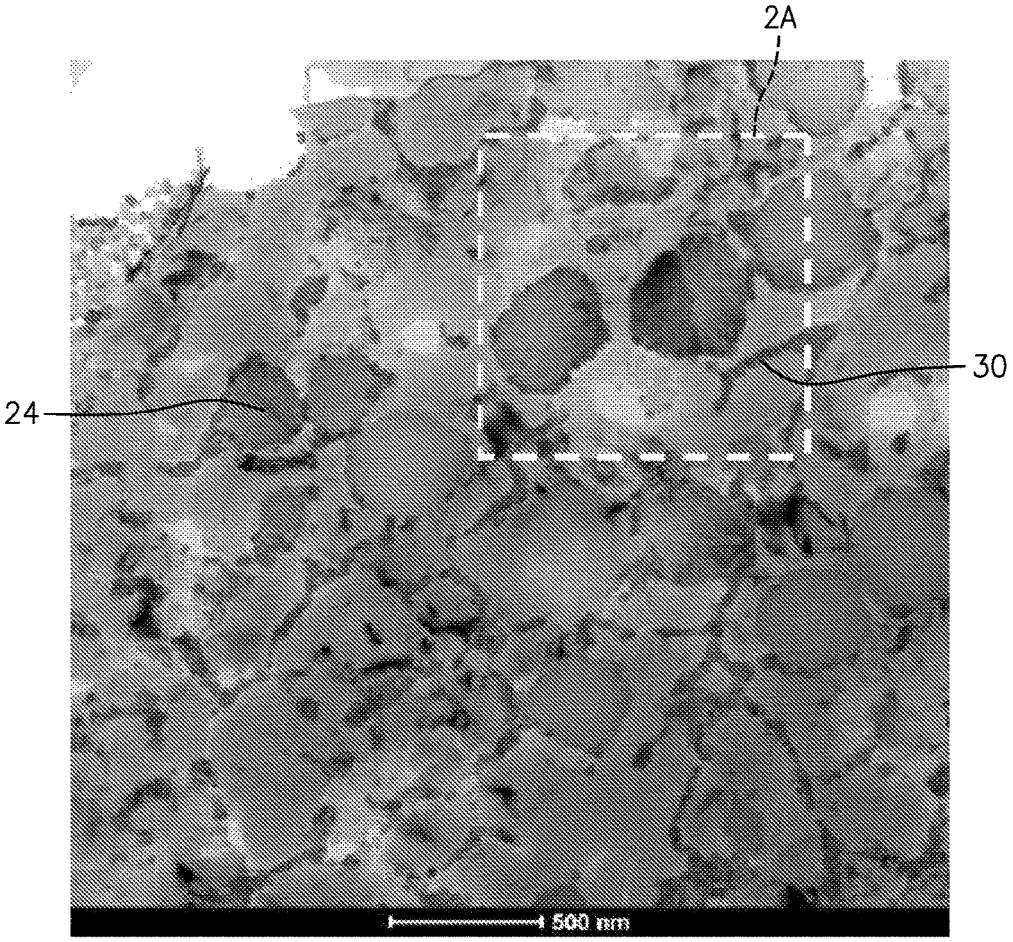
FIG. 2 is a TEM image of the material of FIG. 1 after elevated temperature exposure.
Figure 2A:
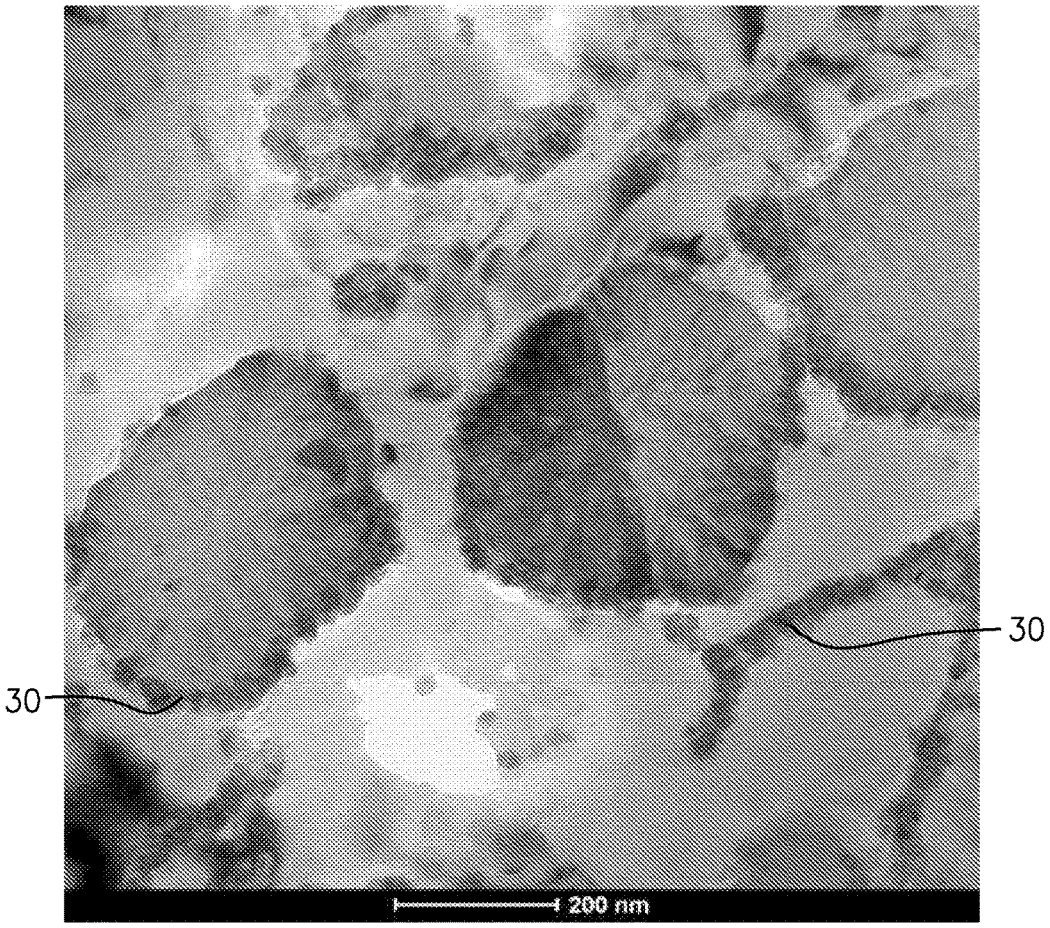
FIG. 2A is an enlarged view of a portion of the image of FIG. 2.

FIG. 2 is a bright field TEM image of the material of FIG. 1 after exposure to elevated temperature (e.g., 600° F., more broadly, at least 575° F. or at least 500° F.). FIG. 2A is an enlarged view of a portion of the image of FIG. 2. Remaining I-phase is seen. Additionally, $Al_9CO_2$ starts to form a continuous network 30 along Al grains and I-phase particles.

Figure 3:
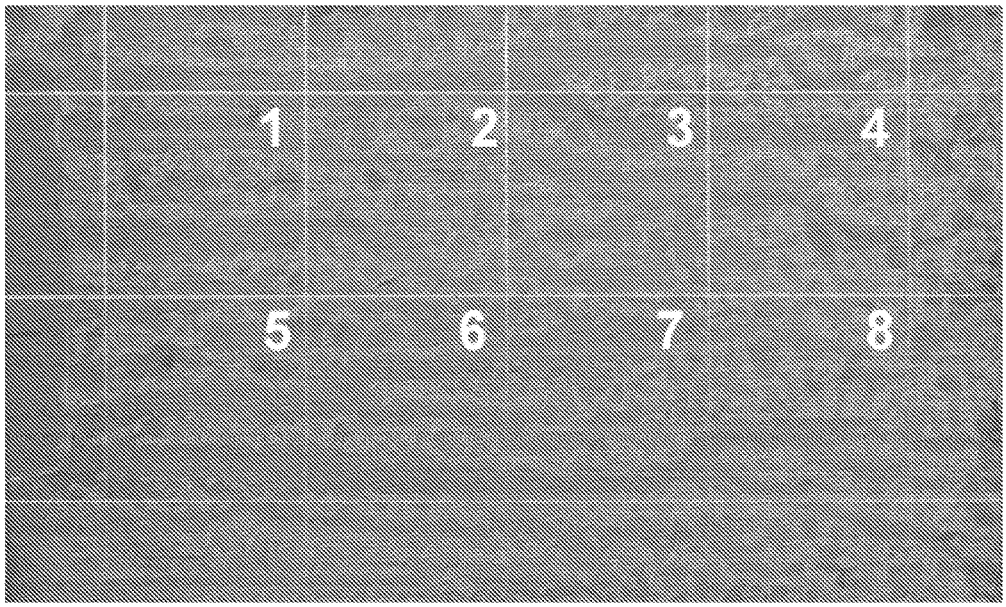
FIG. 3 (PRIOR ART)
FIGS. 3 and 4 respectively are photographs of a conventional aluminum alloy and the Test 1 alloy after salt-fog exposure.
Figure 4:
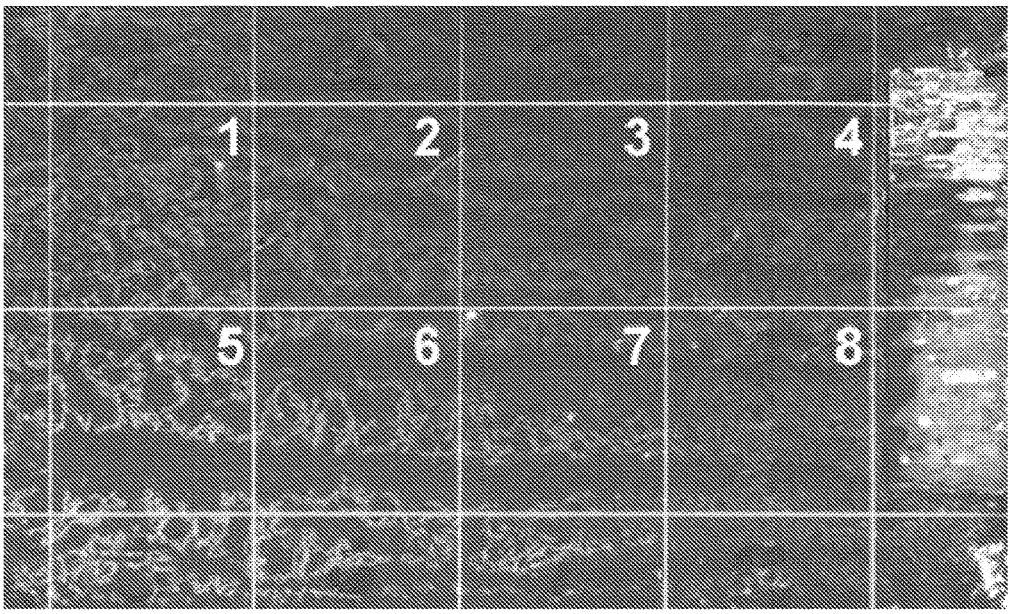

FIGS. 3 and 4 are photographs of a conventional aluminum and the Test 1 specimen after 1008 hours (six weeks) of salt-fog exposure (ASTM B117) and without FIG. 2 heating.

FIG. 5 is a table of wet chemistry of the Test 1 alloy prior to heating and salt-fog.

FIG. 6 is a table of depthwise elemental concentration measured by glow discharge mass spectroscopy of the FIG. 4 material.

Figure 7:
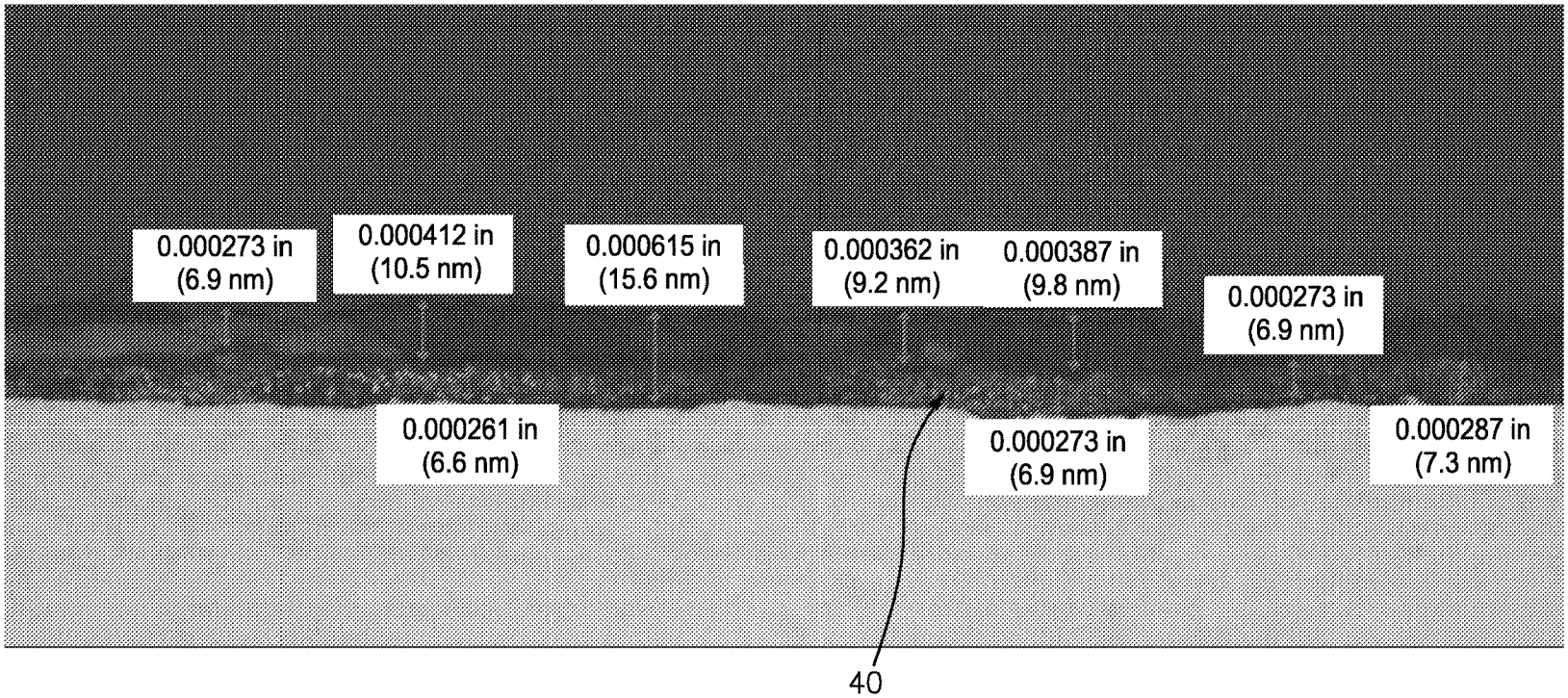
FIG. 7 is an optical micrograph sectional view of the FIG. 4 specimen.

FIG. 7 is an optical micrograph sectional view of the FIG. 4 specimen showing a self-healing passivating layer.

Figure 8:
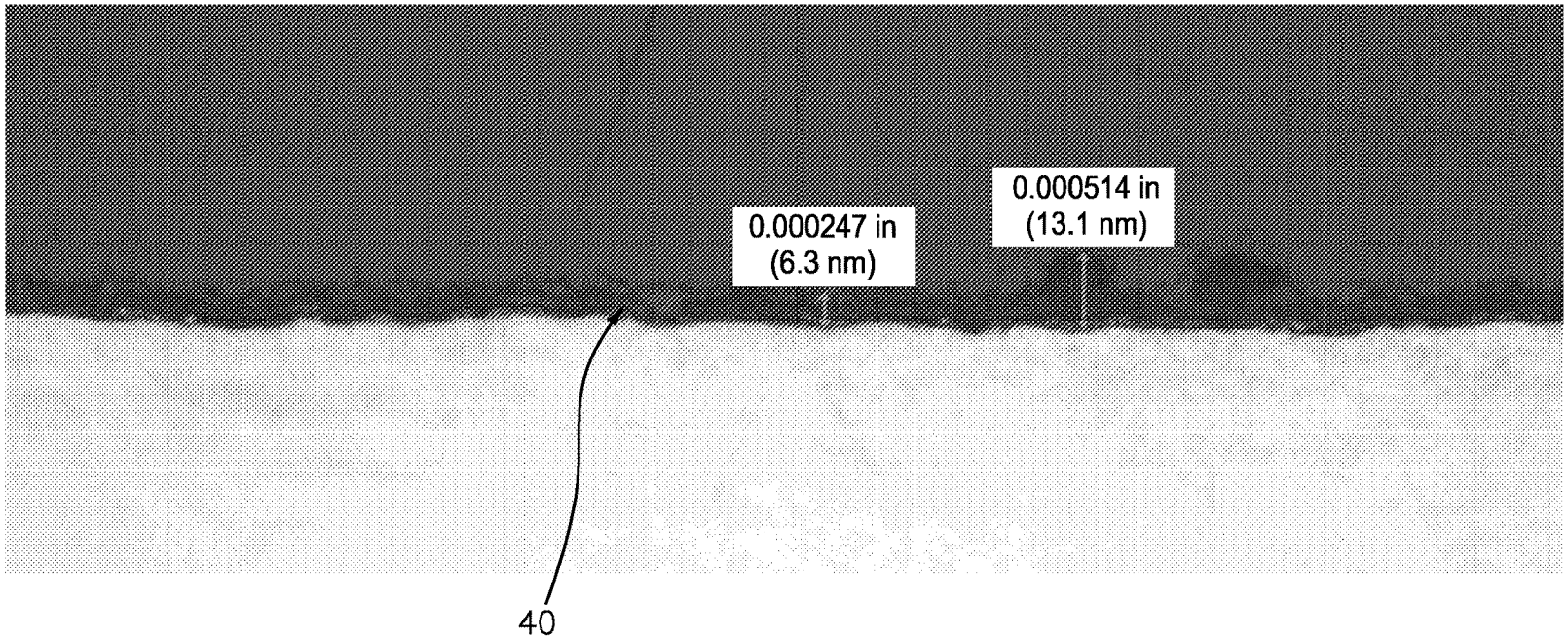
FIG. 8 is an optical micrograph sectional view of the specimen at a first location in FIG. 4.

FIG. 8 is an optical micrograph sectional view of the specimen at a first location in FIG. 4.

Figure 9:
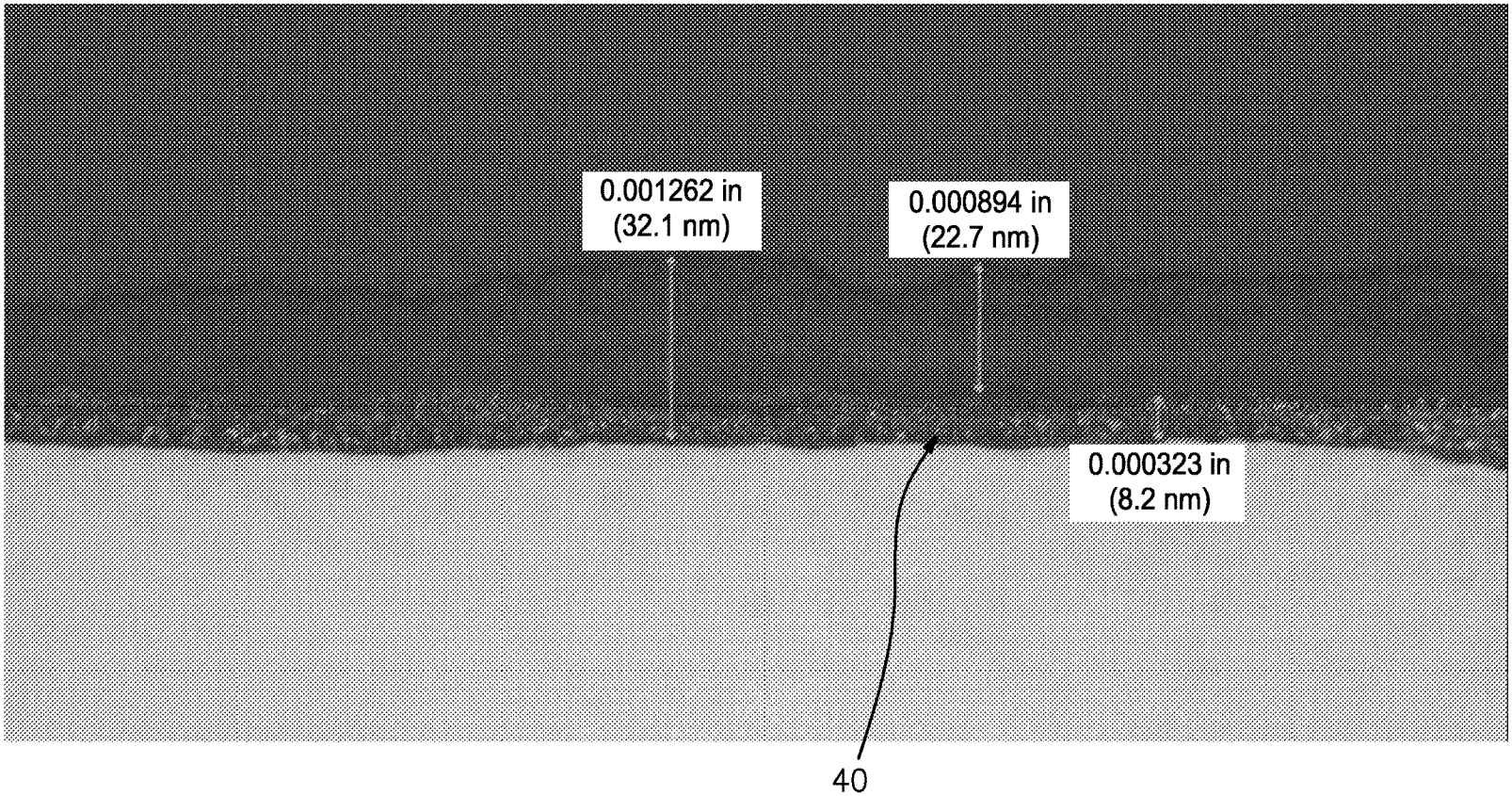
FIG. 9 is an optical micrograph sectional view of the specimen at a second location in FIG. 4.

FIG. 9 is an optical micrograph sectional view of the specimen at a second location in FIG. 4. The FIG. 8 location corresponds to one of the lighter irregular striations whereas the FIG. 9 view corresponds to one of the darker regions and appears to involve a prominent upper sublayer to the passivating layer.

FIG. 10 is an SEM view of the Test 1 alloy as-cut prior to salt-fog exposure.

Figure 11:
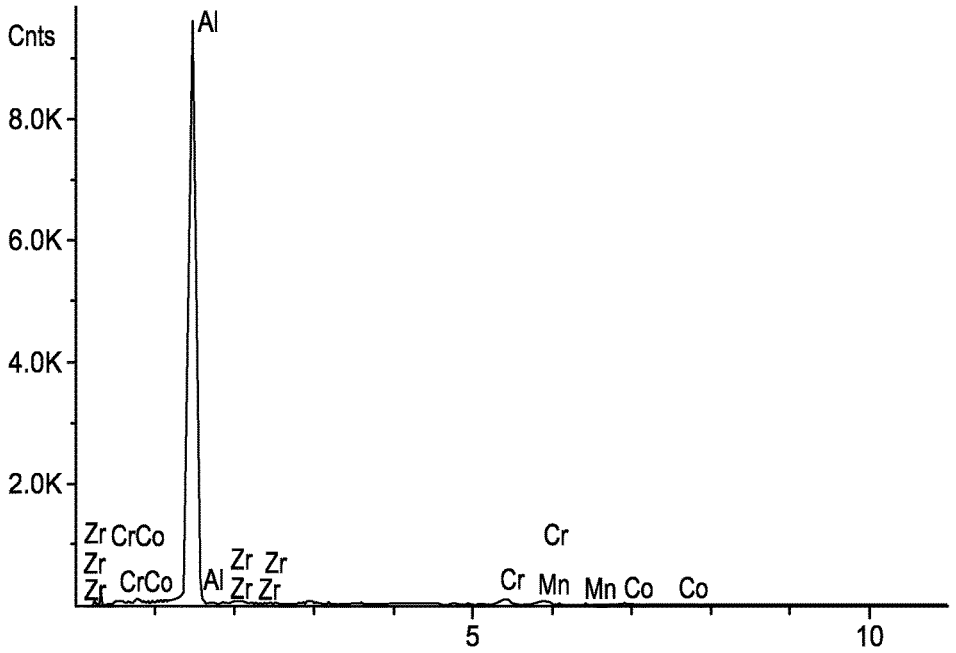
FIG. 11 is an energy-dispersive X-ray spectroscopy (known as EDX or EDS) spectrum of the alloy of FIG. 10.

FIG. 11 is an EDX spectrum of the alloy of FIG. 10.

Figure 12:
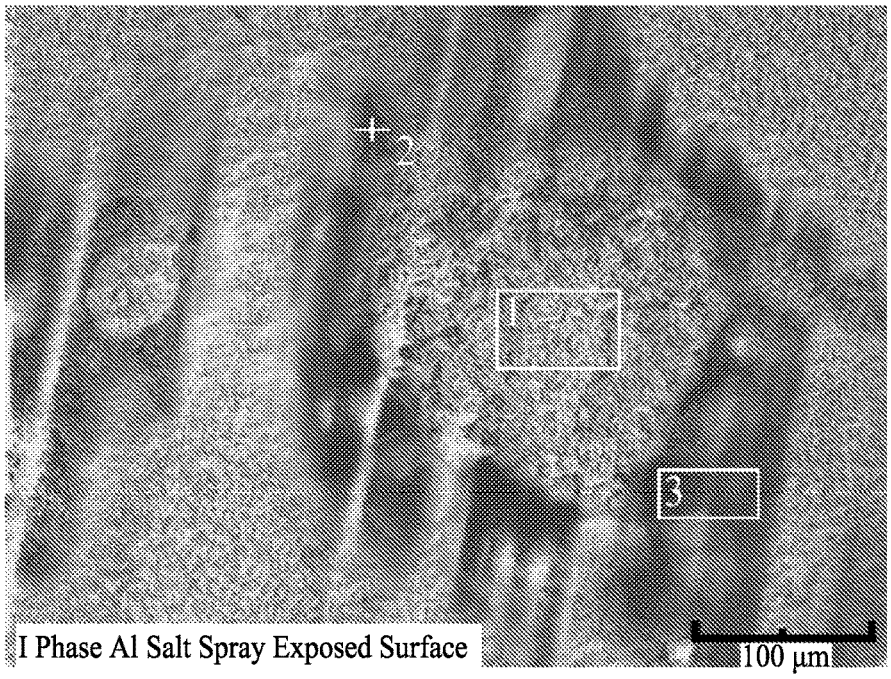
FIG. 12 is an enlarged view of a portion of the passivating layer on the Test 1 alloy after salt-fog exposure.

FIG. 12 is an enlarged view of a portion of the passivating area on the Test 1 alloy after salt-fog exposure.

Figure 13:
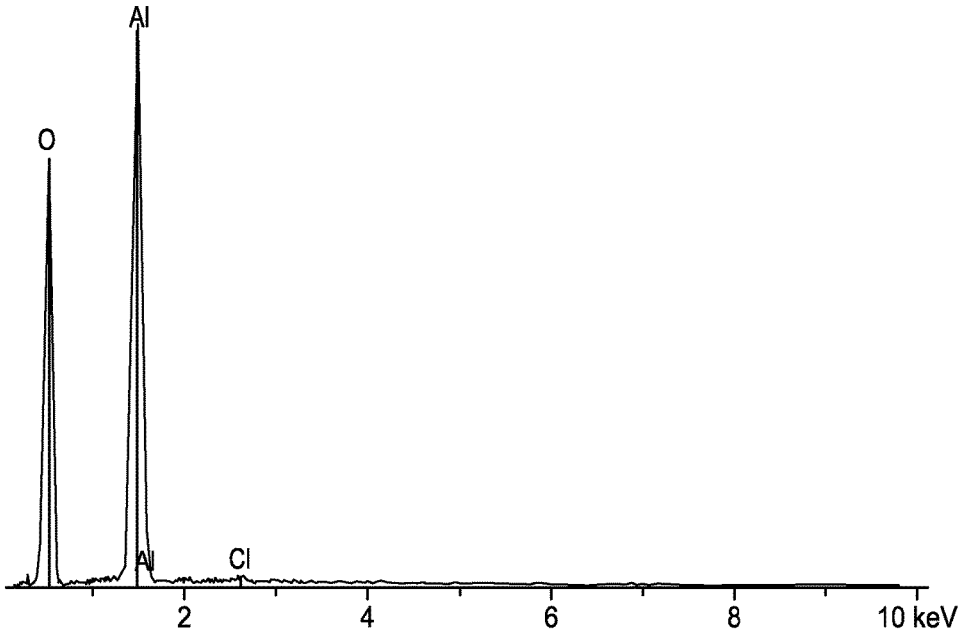
FIG. 13 is an EDX spectrum at location 1 in FIG. 12.

FIG. 13 is an EDX spectrum at location 1 in FIG. 12.

Figure 14:
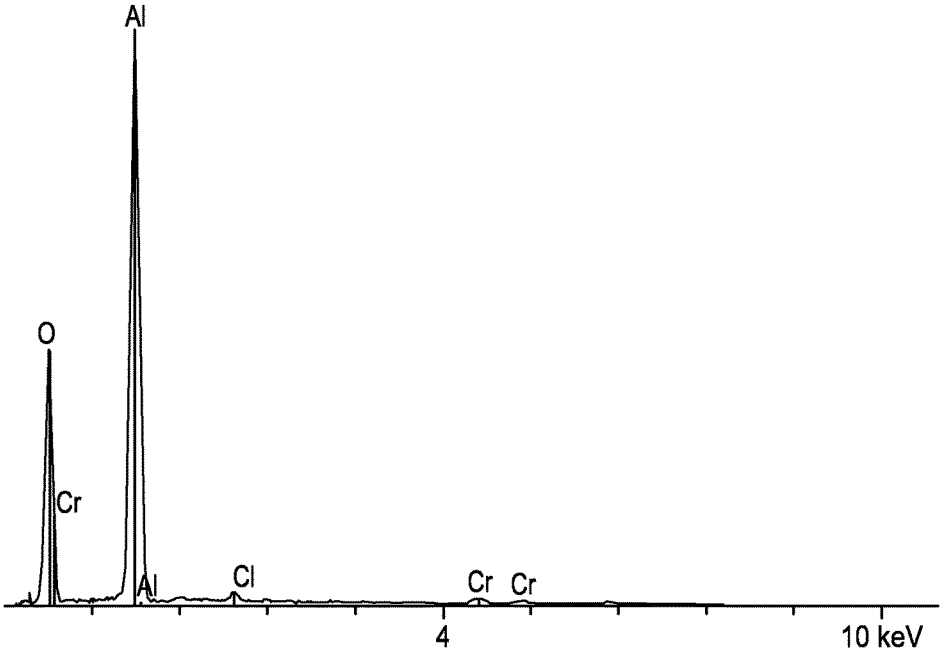
FIG. 14 is an EDX spectrum at location 2 in FIG. 12.

FIG. 14 is an EDX spectrum at location 2 in FIG. 12.

Figure 15:
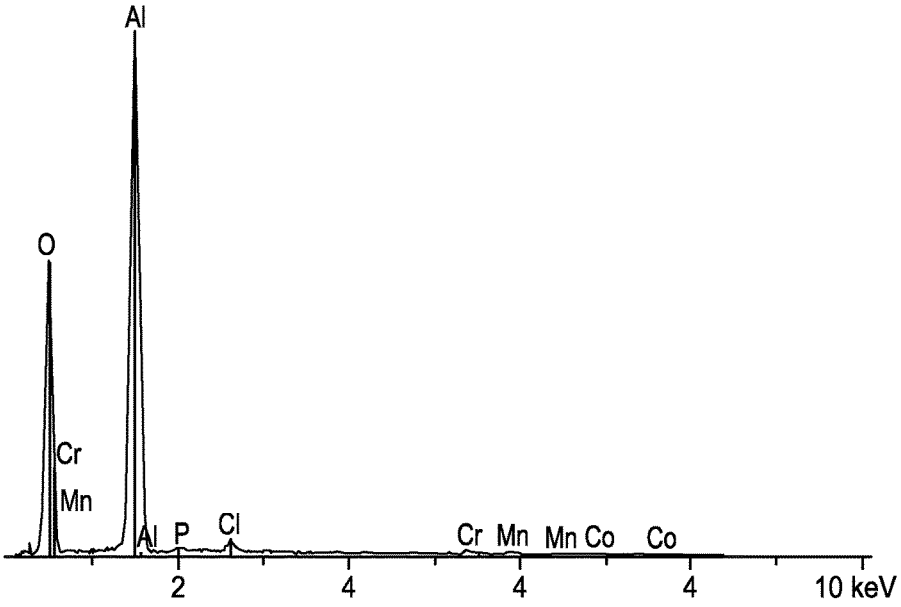
FIG. 15 is an EDX spectrum at location 3 in FIG. 12.

FIG. 15 is an EDX spectrum at location 3 in FIG. 12. Location 1 corresponds to an intact upper sublayer and it is a top view of a surface typical of FIG. 9. Location 2 corresponds to the lower layer and it is a top view of a surface typical of FIG. 8 and shows the presence of chromium in addition to the aluminum, oxygen, and chlorine of FIG. 13. Location 3 corresponds to a region that has not been covered by the passivating layer and shows additional substrate elements wherein the label for phosphorus is believed to correspond to zirconium which has a similar location in the spectrum.

Figure 16:
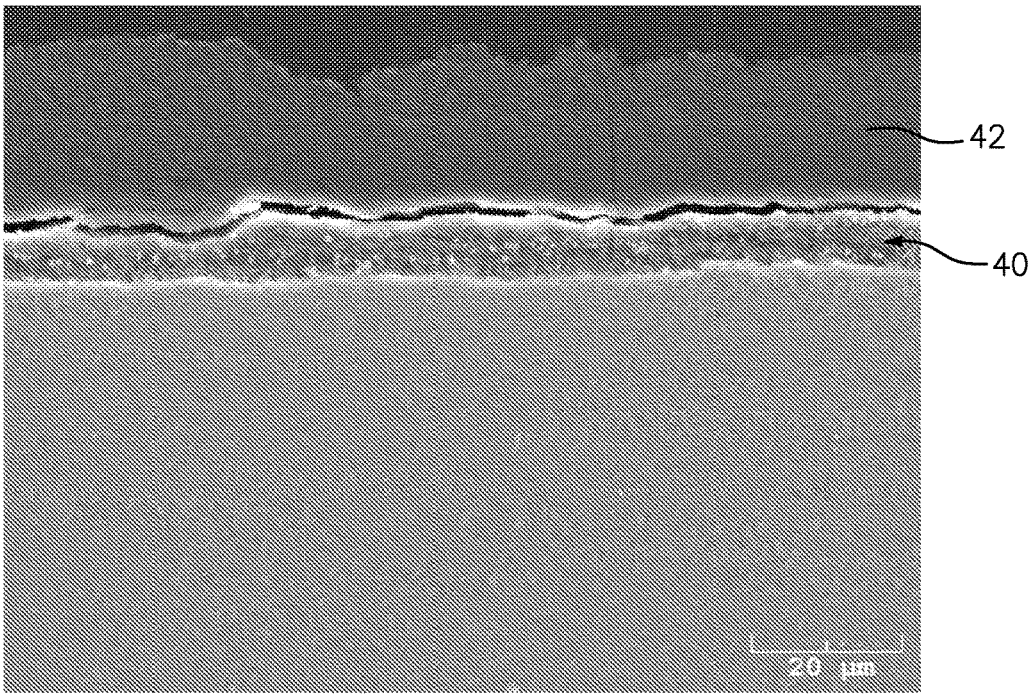
FIG. 16 is a sectional electron microprobe image showing the two-sublayer structure of the passivating layer.
Figure 17:
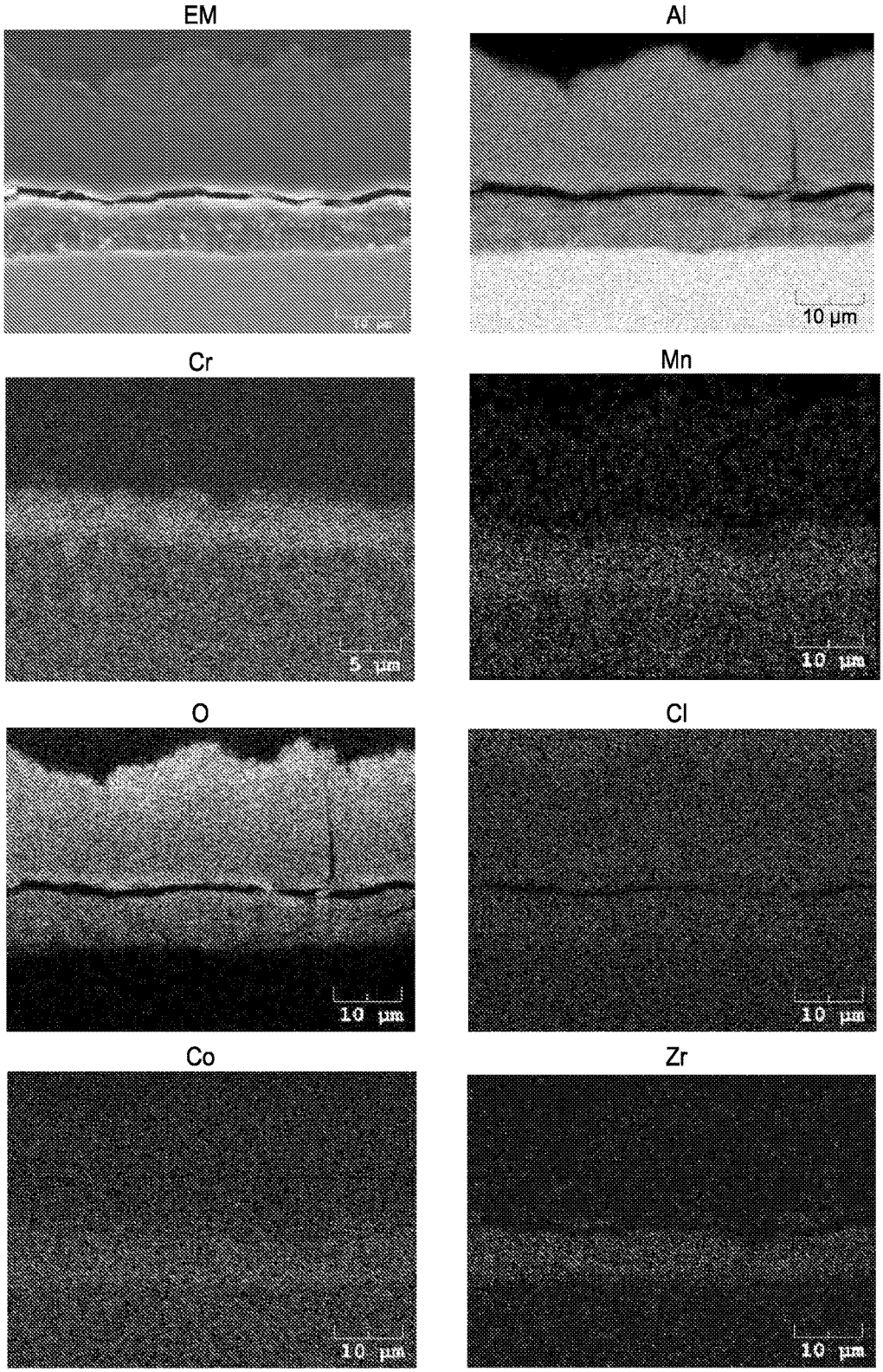
FIG. 17 is a chemical mapping of the two sublayer system.

FIG. 16 is a sectional electromicrograph showing the two-sublayer structure of the passivating layer. FIG. 17 is a chemical mapping of the two sublayer system. From this it is seen that the upper layer 42 is rich in aluminum and oxygen; undoubtedly, an oxide of aluminum, consistent with the spectrum in FIG. 13 for Location 1 in FIG. 12. On the one hand, the upper layer appears to be cracked and separated from the inner layer 40. On the other hand, the lower layer appears to have excellent cohesion to the I-phase alloy and chemical mapping shows that this layer is predominantly Al, O, and Cr, consistent with the spectrum in FIG. 14 for Location 2 in FIG. 12. It is believed that the Cr likely enhances the ductility of the inner layer. The inner layer appears to contain some Mn, Co, and Zr.

FIG. 18 is a sectional electron micrograph of a pit 50 filled by passivating layer material.

Figure 19:
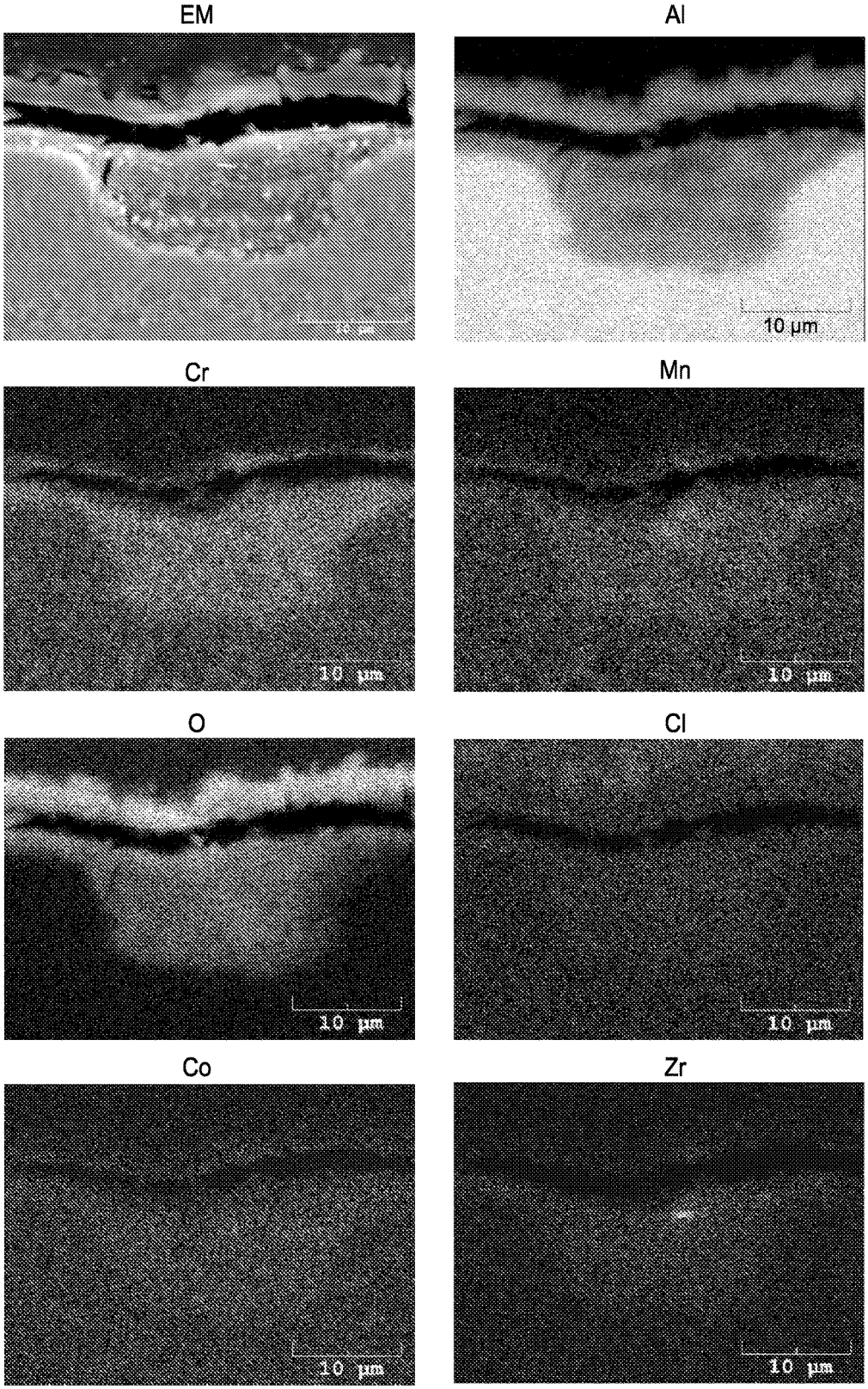
FIG. 19 is a chemical map of the passivated pit.

FIG. 19 is a chemical map of the passivated pit, the compositional data mirroring that for a flat area as discussed above.

Figure 20:
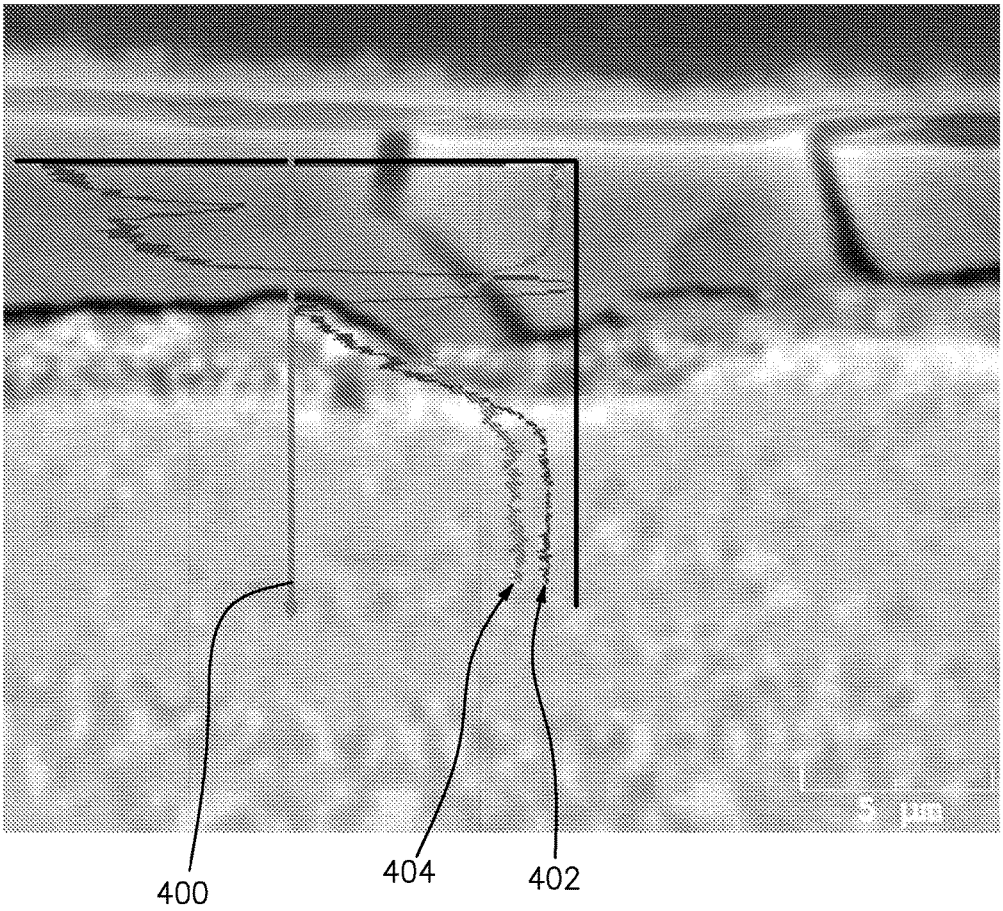
FIG. 20 is a line scan for oxygen and chromium across the two sublayer passivating layer.

FIG. 20 is a line scan (along line 400) for oxygen 402 and chromium 404 across the two sublayer passivating layer. FIGS. 19 and 20 show apparent relative depletion of chromium in the outer sublayer and increased chromium concentration in the inner sublayer. Oxygen tends to generally uniformly increase outward through these two sublayers. As mentioned above, it is believed the chromium depletion causes brittleness which leads both to cracks segmenting the outer sublayer and to the formation of a crack separating the two sublayers from each other.

The exemplary tested lower/inner/inboard sublayer has a thickness of about 8 micrometers, more broadly, 5 micrometers to 10 micrometers or at least 5 micrometers. The observed upper/outer/outboard sublayer has a larger thickness of 15 micrometers to 20 micrometers, more broadly, at least 10 micrometers or 10 micrometers to 25 micrometers. The gap has a thickness of about 1 micrometer to about five micrometers, more particularly between 1.5 micrometers and 3 micrometers. Each identified thickness may be a local thickness or a characteristic thickness (e.g., mean, median, or modal, over an exposed area of a part).

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline, details of such baseline may influence details of particular implementations. Accordingly, other embodiments are within the scope of the following claims.

What is claimed is:

1. A composition comprising, in weight percent:

Al as a largest constituent;

3.7-5.2 Cr;

2.1-3.0 Mn;

0.4-0.6 Co; and 0.7-1.1 Zr.

2. The composition of claim 1 wherein, in atomic percent content, Co divided by the sum (Cr+Mn) is less than or equal to 0.07.

3. The composition of claim 1 wherein, in atomic percent content, Co divided by the sum (Cr+Mn) is less than or equal to 0.065.

4. The composition of claim 1 wherein, in weight percent, the total of all additional contents is not more than 5.0.

5. The composition of claim 1 wherein, in weight percent, no additional individual elemental content exceeds 1.0.

6. The composition of claim 1 wherein, in weight percent, each of Fe and Si content, if any, does not exceed 0.02.

7. The composition of claim 1 wherein, by weight, H content, if any, does not exceed 1 ppm.

8. The composition of claim 1 having an icosahedral phase (I-phase).

9. The composition of claim 8 wherein a volume fraction of said I-phase is 15% to 30%.

10. The composition of claim 8 wherein an average size of said I-phase is less than 200 nm.

11. The composition of claim 1 wherein $Al_9Co_2$ content, if any, is less than 5% by volume.

12. A method for manufacturing the composition of claim 1, the method comprising:

atomizing a master alloy;

pressing the atomized alloy to form a billet;

extruding the billet to form an extrusion; and forging the extrusion.

13. A composition comprising, in atomic percent:

Al as a largest constituent;

1.9-2.9 Cr;

1.0-1.6 Mn;

0.2-0.3 Co; and 0.2-0.4 Zr.

14. The composition of claim 13 having an icosahedral phase (I-phase).

15. The composition of claim 14 wherein a volume fraction of said I-phase is 15% to 30%.

16. The composition of claim 13 being a powder metallurgical alloy.

17. The composition of claim 13 wherein the composition is effective to form a passivating layer when exposed to a salt fog environment.

* * * * *